US008610705B2

(12) United States Patent
Lee et al.

(10) Patent No.: US 8,610,705 B2
(45) Date of Patent: Dec. 17, 2013

(54) APPARATUS AND METHOD FOR DRIVING LIQUID CRYSTAL DISPLAY DEVICE

(75) Inventors: Sang Hoon Lee, Daegu-si (KR); Hwa Young Kim, Suwon-si (KR)

(73) Assignee: LG Display Co., Ltd., Seoul (KR)

( * ) Notice: Subject to any disclaimer, the term of this patent is extended or adjusted under 35 U.S.C. 154(b) by 725 days.

(21) Appl. No.: 12/243,751

(22) Filed: Oct. 1, 2008

(65) Prior Publication Data

US 2009/0122054 A1 May 14, 2009

(30) Foreign Application Priority Data

Nov. 12, 2007 (KR) ..... 10-2007-0114937

(51) Int. Cl.
*G09G 3/18* (2006.01)

(52) U.S. Cl.
USPC ..... 345/214; 345/89

(58) Field of Classification Search
USPC ..... 345/214
See application file for complete search history.

(56) References Cited

U.S. PATENT DOCUMENTS

| | | | | |
|---|---|---|---|---|
| 5,956,007 | A | 9/1999 | Ito et al. | |
| 6,072,451 | A * | 6/2000 | Mano et al. | 345/89 |
| 2001/0004253 | A1 * | 6/2001 | Fukutoku et al. | 345/96 |
| 2005/0174360 | A1 * | 8/2005 | Daly et al. | 345/596 |
| 2005/0195144 | A1 | 9/2005 | Kwon et al. | |
| 2006/0087696 | A1 * | 4/2006 | Lee | 358/3.13 |
| 2007/0120794 | A1 * | 5/2007 | Shin et al. | 345/89 |
| 2008/0036797 | A1 * | 2/2008 | Whang | 345/698 |
| 2008/0224976 | A1 * | 9/2008 | Lee et al. | 345/89 |
| 2008/0309656 | A1 * | 12/2008 | Van Woudenberg et al. | 345/214 |

FOREIGN PATENT DOCUMENTS

| | | | |
|---|---|---|---|
| CN | 1763825 | A | 4/2006 |
| CN | 1941062 | A | 4/2007 |
| CN | 101010718 | A | 8/2007 |
| JP | 7-134280 | A | 5/1995 |
| JP | 8-202317 | A | 8/1995 |
| JP | 8-69264 | A | 3/1996 |
| JP | 10-116055 | A | 5/1998 |
| JP | 11-95725 | A | 4/1999 |
| JP | 11-119740 | A | 4/1999 |
| JP | 2000-56726 | A | 2/2000 |
| JP | 2003-295160 | A | 10/2003 |
| JP | 2004-302023 | A | 10/2004 |
| JP | 2005-242359 | A | 9/2005 |

* cited by examiner

*Primary Examiner* — Seokyun Moon
*Assistant Examiner* — Jose Soto Lopez
(74) *Attorney, Agent, or Firm* — Birch, Stewart, Kolasch & Birch, LLP

(57) ABSTRACT

An apparatus for driving a liquid crystal display device, and which includes an image analyzer configured to compare a pattern of input image data with a plurality of stored patterns of image data, to determine a stored pattern of image data from the plurality of stored patterns of image data that is most similar to the pattern of the input image data, and to output a pattern analysis signal indicating the determined stored pattern, and a dithering unit connected to the image analyzer and configured to select a dithering pattern based on the output pattern analysis signal, to dither the input image data based on the selected dithering pattern, and to output a dither-processed image data.

14 Claims, 6 Drawing Sheets

(dot pattern)

(horizontal line pattern)

(vertical 2-dot pattern)

(vertical line pattern)

( sub-dot pixel pattern)

(horizontal 2-dot pattern)

APPARATUS AND METHOD FOR DRIVING LIQUID CRYSTAL DISPLAY DEVICE

This application claims the benefit of the Korean Patent Application No. 10-2007-0114937, filed in Korea on Nov. 12, 2007, which is hereby incorporated by reference as if fully set forth herein.

BACKGROUND OF THE INVENTION

1. Field of the Invention

The present invention relates to a liquid crystal display device, and more particularly, to an apparatus and method for driving a liquid crystal display device that selectively changes frame rate control (FRC) dithering patterns based on characteristics of an input image data to improve picture quality.

2. Discussion of the Related Art

Flat panel displays include a liquid crystal display, a field emission display, a plasma display panel, a light emitting display, and the like. The liquid crystal display, among the flat panel displays, displays an image by adjusting the light transmittance of a liquid crystal using an electric field.

Further, the liquid crystal display includes a liquid crystal panel having a plurality of pixels, a backlight unit for irradiating light to the liquid crystal panel, and a driving circuit for driving the pixels. The liquid crystal panel also includes a plurality of gate lines and a plurality of data lines arranged to intersect each other, and the pixels are located respectively in areas defined by the intersections of the gate lines and the data lines.

A pixel electrode and a common electrode for applying an electric field are also formed in each of the pixels. Further, the pixel electrode is connected with a thin film transistor (TFT), which is a switching element. The TFT is turned on by a scan pulse from each gate line to charge a data signal from each data line in the pixel electrode.

In addition, the driving circuit includes a gate driver for driving the gate lines, a data driver for driving the data lines, a timing controller for supplying control signals for controlling the gate driver and data driver, and a power supply for supplying driving voltages used to drive the liquid crystal panel and the respective drivers.

The liquid crystal display uses a frame rate control (FRC) dithering method to increase the number of gray scales of an image to be displayed. In more detail, the FRC dithering method is used to partition pixels into dither blocks each having a certain size to adjust the brightness of pixels in each block, and to make the brightness of the pixels in each block different for every frame so as to display a larger number of gray scales rather than a set one.

For example, when the FRC dithering method is used in a liquid crystal display where one pixel can display an 18-bit color with a combination of R, G and B data, it is possible to obtain a similar effect to displaying a 24-bit color with a combination of R, G and B data, each R, G and B data being 8 bits long. Thus, the liquid crystal display input R, G and B data of 18 bits can be displayed as a number of gray scales corresponding to R, G and B data of 24 bits.

However, the related art FRC dithering method is disadvantageous because it is used in the same manner irrespective of an inversion mode of a liquid crystal display or characteristics of an image being displayed on the liquid crystal display, resulting in a degradation in picture quality. In other words, when a liquid crystal display is driven in a dot inversion mode and displays an image having a certain horizontal or vertical pattern, a flicker may occur in which pixels at specific positions seem to shine.

Thus, because the related art FRC dithering method is used in the same manner irrespective of an inversion mode or characteristics of an image, a flicker, noise, dark bar or the like may occur in a specific pattern such as a dot pattern or horizontal/vertical striped pattern, causing a degradation in picture quality.

SUMMARY OF THE INVENTION

Accordingly, one object of the present invention is to address the above-noted and other drawbacks.

Another object of the present invention is to provide an apparatus and method for driving a liquid crystal display device, which selectively changes FRC dithering patterns based on at least one of characteristics of input image data and an inversions mode of the liquid crystal display device so as to improve the picture quality.

To achieve these and other advantages and in accordance with the purpose of the present invention, as embodied and broadly described herein, the present invention provides in one aspect an apparatus for driving a liquid crystal display device. The apparatus includes an image analyzer configured to compare a pattern of input image data with a plurality of stored patterns of image data, to determine a stored pattern of image data from the plurality of stored patterns of image data that is most similar to the pattern of the input image data, and to output a pattern analysis signal indicating the determined stored pattern and a dithering unit connected to the image analyzer and configured to select a dithering pattern based on the output pattern analysis signal, to dither the input image data based on the selected dithering pattern, and to output a dither-processed image data.

In another aspect, the present invention provides a method of driving a liquid crystal display device. The method includes comparing a pattern of input image data with a plurality of stored patterns of image data, determining a stored pattern of image data from the plurality of stored patterns of image data that is most similar to the pattern of input image data, outputting a pattern analysis signal indicating the determined stored pattern, selecting a dithering pattern based on the output pattern analysis signal, dithering the input image data based on the selected dithering pattern, and outputting a dither-processed image data.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
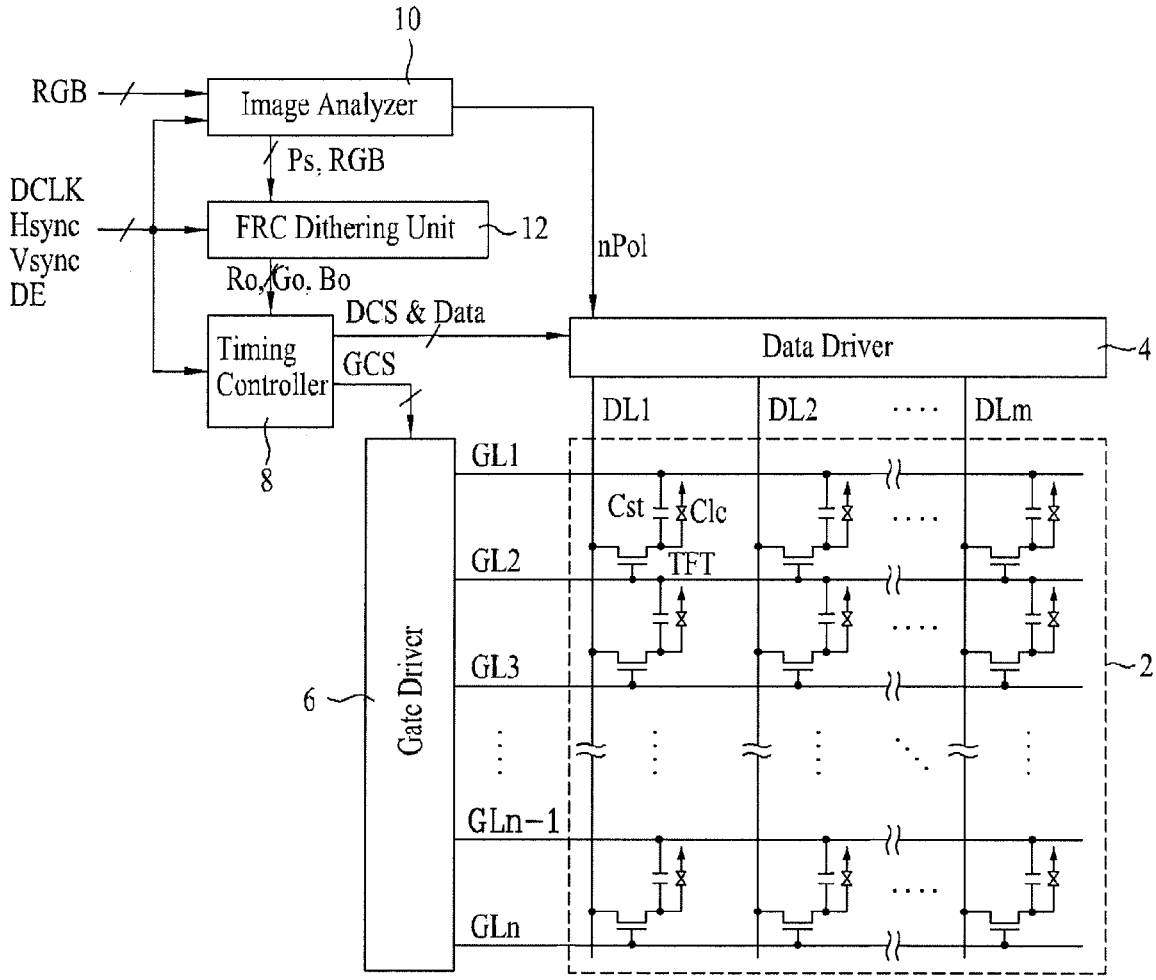
FIG. 1 is a schematic view of a driving apparatus of a liquid crystal display device according to an embodiment of the present invention.

FIG. 1 schematically shows the configuration of a driving apparatus of a liquid crystal display device according to an embodiment of the present invention. As shown, the driving apparatus includes a liquid crystal panel 2 having a plurality of pixels, an image analyzer 10 for analyzing a pattern of externally input image data RGB and outputting an inversion mode signal nPol and a pattern analysis signal Ps according to the analysis result.

Also included is a data driver 4 for driving a plurality of data lines DL1 to DLm in response to the inversion mode signal nPol, a gate driver 6 for driving a plurality of gate lines GL1 to GLn, and an FRC dithering unit 12 for FRC-dithering the image data RGB in response to the pattern analysis signal Ps. The driving apparatus also includes a timing controller 8 for arranging the data Ro, Go and Bo from the FRC dithering unit 12 and supplying the arranged data to the data driver 4, and for generating gate and data control signals GCS and DCS to control the gate driver 6 and data driver 4, respectively.

Further, as shown in FIG. 1, the liquid crystal panel 2 includes thin film transistors (TFTs) formed respectively in pixel areas defined by the gate lines GL1 to GLn and the data lines DL1 to DLm, and liquid crystal capacitors Clc connected respectively to the TFTs. In addition, each liquid crystal capacitor Clc is made up of a pixel electrode connected to a corresponding one of the TFTs, and a common electrode facing the pixel electrode with a liquid crystal interposed therebetween.

Also, each TFT supplies a data signal from a corresponding one of the data lines DL1 to DLm to the pixel electrode in response to a scan pulse, or gate on signal, from a corresponding one of the gate lines GL1 to GLn. The liquid crystal capacitor Clc is also charged with a difference voltage between the data signal supplied to the pixel electrode and a common voltage supplied to the common electrode, and varies the alignment of liquid crystal molecules based on the difference voltage to adjust the light transmittance of the liquid crystal molecules so as to provide a gray scale.

Further, a storage capacitor Cst is connected in parallel to the liquid crystal capacitor Clc to maintain the voltage charged in the liquid crystal capacitor Clc until a next data signal is supplied. The storage capacitor Cst is formed by an overlap of the pixel electrode and a previous gate line via an insulating film. Alternatively, the storage capacitor Cst may be formed by an overlap of the pixel electrode and a storage line via an insulating film.

In addition, the data driver 4 converts digital data from the timing controller 8 into analog data voltages, that is, image signals, in response to the data control signal DCS from the timing controller 8 and the inversion mode signal nPol from the image analyzer 10. Then, the data driver 4 supplies image signals of one horizontal line respectively to the data lines DL1 to DLm in every horizontal period where the scan pulse is supplied to each gate line GL1 to GLn.

That is, the data driver 4 selects a positive or negative gamma voltage having a certain level based on a gray scale value of each data and the inversion mode signal nPol and supplies the selected gamma voltage as an image signal to each data line DL1 to DLm. Further, the gate driver 6 sequentially generates and supplies the scan pulse, for example, the gate on voltage to the gate lines GL1 to GLn in response to the gate control signal GCS from the timing controller 8.

The image analyzer 10 analyzes the pattern of the input image data RGB using external input synchronous signals DCLK, DE, Hsync and Vsync and outputs the inversion mode signal npol and pattern analysis signal Ps according to a result of the analysis. The image analyzer 10 also analyzes the pattern of the input image data RGB for every at least one frame in response to the external synchronous signals DCLK, DE, Hsync and Vsync.

For example, the image analyzer 10 analyzes on a horizontal line basis or on a frame basis whether the pattern of an input image is most similar to which one of a vertical pattern, horizontal pattern, 1-dot pattern, vertical 2-dot pattern, horizontal 2-dot pattern, etc., and outputs the pattern analysis signal Ps according to a result of the analysis to the FRC dithering unit 12.

Also, the image analyzer 10 generates the inversion mode signal nPol based on the analyzed image pattern, namely, the pattern analysis signal Ps so as to set the inversion mode of the liquid crystal display device to any one of a vertical inversion mode, horizontal inversion mode, 1-dot inversion mode, vertical 2-dot inversion mode, horizontal 2-dot inversion mode or square inversion mode, and supplies the generated inversion mode signal nPol to the data driver 4. The image analyzer 10 may also supply the pattern analysis signal Ps with the inversion mode signal nPol to FRC dithering unit 12.

In addition, the FRC dithering unit 12 FRC-dithers the image data RGB in response to the pattern analysis signal Ps from the image analyzer 10 and then output the FRC-dithered data Ro, Go and Bo. The FRC dithering unit 12 selects one set from a plurality of sets of FRC dither patterns capable of minimizing a degradation of picture quality, based on the pattern analysis signal Ps.

In other words, the FRC dithering unit 12 selects a suitable set of FRC dither patterns that prevent a predetermined image pattern from being interfered with a predetermined FRC dither pattern according to the pattern analysis signal Ps. As the predetermined image pattern is interfered with the predetermined FRC dither pattern, positive pixels or negative pixels in pixel areas, corresponding to the predetermined image pattern, may increase relatively, thereby causing the degradation in picture quality.

Thus, the FRC dithering unit 12 selects the set of FRC dither patterns optimized to the analyzing image pattern in the image analyzer 10 such that a number of positive pixels and a number of negative pixels are similar in the corresponding pixel areas. Then, the FRC dithering unit 12 spatially and temporally disperses some low-order bits of the input image data RGB using the selected set of FRC dither patterns to more finely change a brightness of the input image data RGB.

The FRC dithering unit 12 then outputs the image data Ro, Go and Bo that has the decreased number of bits, compared with the input image data Rc, Gc and Bc, by the FRC dithering method. Thus, the FRC dithering unit 12 prevents interference between the predetermined image pattern and the predetermined FRC dither pattern, thereby minimizing the degradation of the picture quality.

In addition, the timing controller 8 suitably arranges the data Ro, Go and Bo from the FRC dithering unit 12 for driving the liquid crystal panel 2 and supplies the arranged data to the data driver 4. Also, the timing controller 8 generates the gate control signal GCS and the data control signal DCS using the external synchronous signals DCLK, DE, Hsync and Vsync to control the gate driver 6 and data driver 4, respectively.

Figure 2:
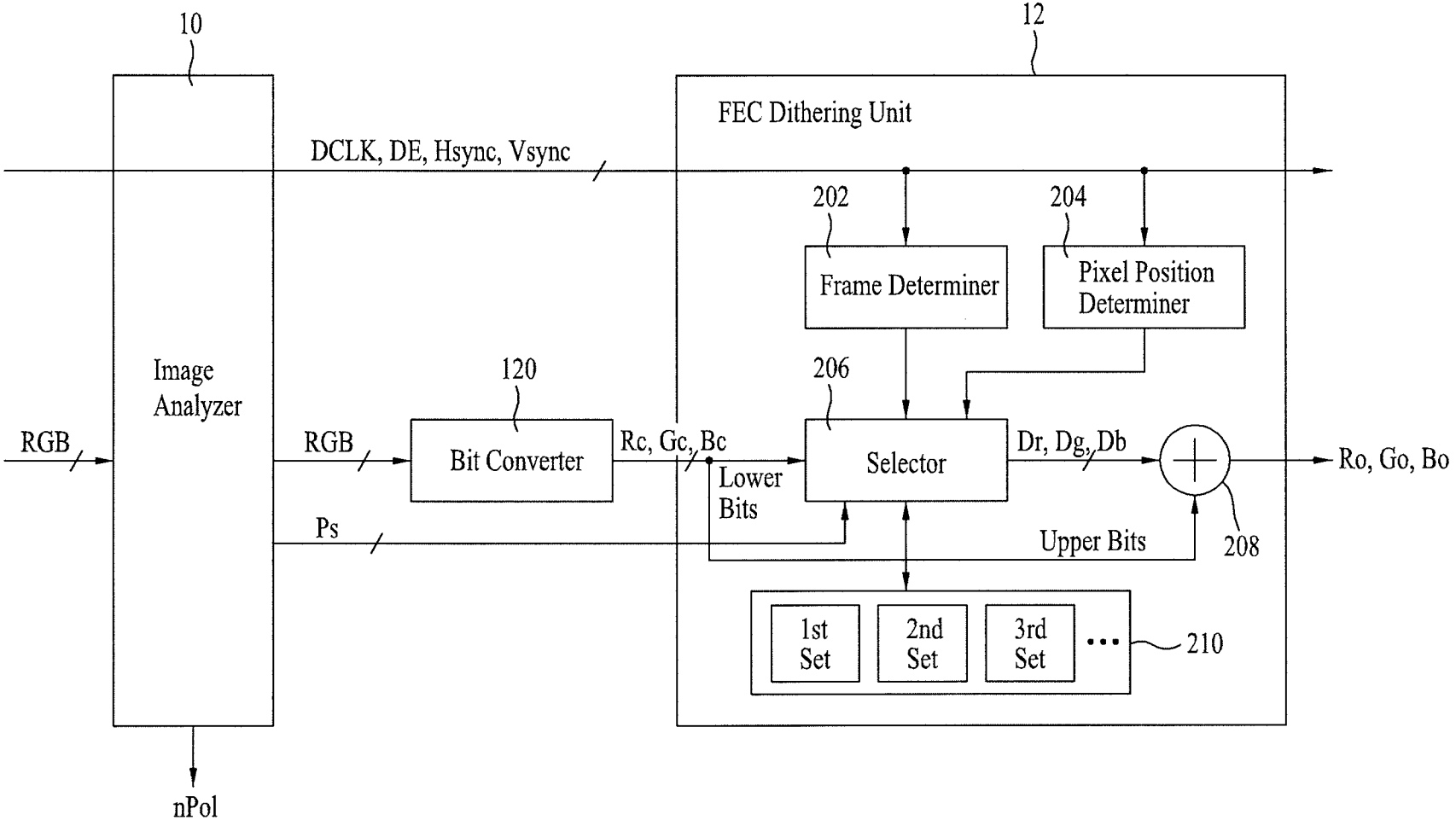
FIG. 2 is a block diagram of an image analyzer and an FRC dithering unit shown in FIG. 1.
Figure 3:
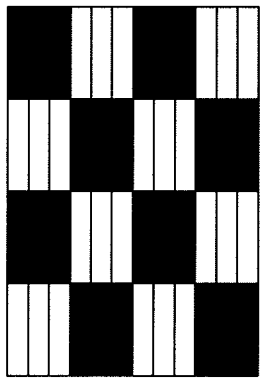
FIG. 3 is an overview showing examples of patterns analyzed by the image analyzer of FIG. 2.
Figure 3:
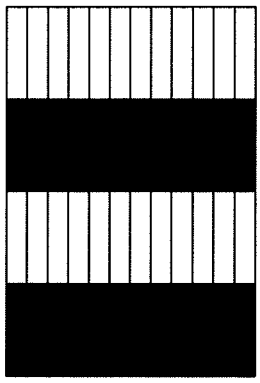
Figure 3:
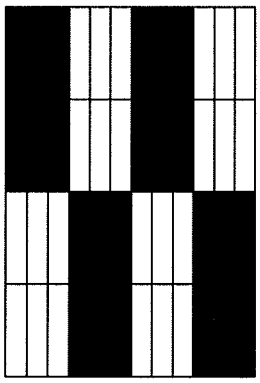
Figure 3:
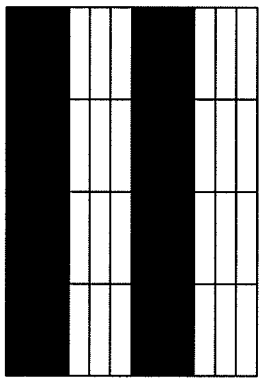
Figure 3:
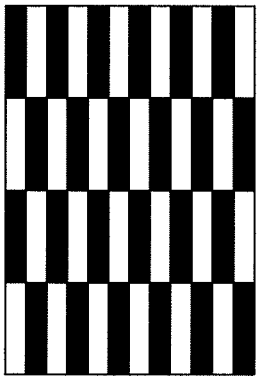
Figure 3:
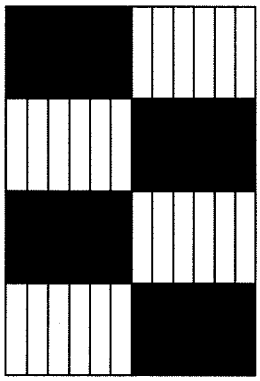

Next, FIG. 2 is a block diagram of the image analyzer 10 and FRC dithering unit 12 shown in FIG. 1, and FIG. 3 shows patterns analyzed by the image analyzer 10 of FIG. 2.

In addition, the image analyzer 10 analyzes the pattern of the input image data RGB for every at least one frame in response to the external synchronous signals DCLK, DE, Hsync and Vsync and outputs the pattern analysis signal Ps and the inversion mode signal nPol according to a result of the analysis.

In more detail, the image analyzer 10 sequentially compares the pattern of the input image data RGB with a plurality of analysis patterns on a horizontal line basis or on a frame basis using at least one of the external input synchronous signals DCLK, DE, Hsync and Vsync. That is, the image analyzer 10 includes at least one memory and a comparator, and compares the pattern of the input image data ROB with analysis patterns stored in the memory.

For example, as shown in FIG. 3, the stored analysis patterns can be a dot pattern, horizontal/vertical line pattern, vertical 2-dot pattern, sub-dot pixel pattern, horizontal 2-dot pattern, etc. Thus, the image analyzer 10 generates synchronous signals by sequentially comparing the input image data ROB with the plurality of analysis patterns.

The image analyzer 10 then counts the number of the generated synchronous signals and outputs the pattern analysis signal Ps based on an analysis pattern determined to be most similar to the pattern of the input image data RGB, for example, an analysis pattern in which the synchronous signals are most often generated, among the plurality of analysis patterns.

For example, when the image analyzer 10 sequentially compares the pattern of the input image data RGB with the plurality of analysis patterns for every at least one frame and determines from the comparison result that the largest number of synchronous signals are generated when the pattern of the input image data RGB is compared with the vertical 2-dot pattern, the image analyzer 10 generates a corresponding 3-bit pattern analysis signal Ps.

Then, the image analyzer 10 supplies the 3-bit pattern analysis signal Ps, for example, "011" signal to the FRC dithering unit 12. The image analyzer 10 also outputs the inversion mode signal nPol for minimizing a degradation of picture quality corresponding to the pattern analysis signal Ps. Further, the inversion mode signal nPol corresponding to the pattern analysis signal Ps may be preset by a designer. In other words, when the pattern analysis signal Ps is "011" indicating the vertical 2-dot pattern, the image analyzer 10 may generate the inversion mode signal nPol such that the liquid crystal display device is driven in the horizontal 2-dot inversion mode.

Also, when the pattern analysis signal Ps is "001" indicating the horizontal line pattern, the image analyzer 10 may generate the inversion mode signal nPol such that the liquid crystal display device is driven in the vertical line inversion mode. In this manner, the image analyzer 10 generates the inversion mode signal nPol corresponding to the pattern analysis signal Ps so as to set the inversion mode of the liquid crystal display device to the vertical inversion mode, horizontal inversion mode, 1-dot inversion mode, vertical 2-dot inversion mode, horizontal 2-dot inversion mode or square inversion mode, and supplies the generated inversion mode signal nPol to the data driver 4, The image with the inversion mode signal nPol to the FRC dithering unit 12.

In addition, as shown in FIG. 2, a bit converter 120 is connected between the image analyzer 10 and the FRC dithering unit 12. The bit converter 120 converts the number of bits of the input image data RGB from the image analyzer 10 and supplies the bit-converted image data RC, Gc and Be to the FRC dithering unit 12. Further, the bit converter 120 increases the number of bits of the input image data RGB from the image analyzer 10 and supplies the bit-increased image data Rc, Gc and Be to the FRC dithering unit 12.

The bit converter 120 also includes a memory for storing a look-up table (LUT) and converts the number of bits of the input image data RGB using the LUT and outputs image data Rc, Gc and Bc of the converted bit number. In more detail, when the respective R, G and B image data RGB are input on an 8-bits basis, the bit converter 120 outputs corresponding R, G and B image data Rc, Gc and Bc, each being 9 bits long. Further, each of the converted image data RC, Gc and Be is data with a 1 bit, "0" or "1", added to a least significant bit (LSB) of the corresponding input image data RGB.

As shown in FIG. 2, the FRC dithering unit 12 includes a frame determiner 202, a pixel position determiner 204, a memory 210, selector 206 and an adder 208. The frame determiner 202 counts the number of frames and outputs information about the counted frame number. The pixel position determiner 204 detects pixel positions of the image data Rc, Gc and Bc from the bit converter 120 and outputs information about the detected pixel positions.

In addition, the memory 210 stores a plurality of sets of FRC dithering patterns, and the selector 206 selects one set from the plurality of sets of FRC dithering patterns in the memory 210 based on the pattern analysis signal Ps from the image analyzer 10 and selects a corresponding dithering bit Dr, Dg or Db in the selected set of FRC dithering patterns using some low-order bits of each of the input image data Rc, Gc and Bc, the frame number information from the frame determiner 202, and the pixel position information from the pixel position determiner 204.

Further, the adder 208 adds some high-order bits separated from each of the input image data Rc, Gc and Bc from the bit converter 120 and each of the dithering bits Dr, Dg and Db selected by the selector 206. For example, each of the image data Rc, Gc and Bc from the bit converter 120 is separated into high-order 6 bits and low-order 3 bits, and the separated high-order 6 bits are supplied to the adder 208 and the separated low-order 3 bits are supplied to the selector 206.

Also, the frame determiner 202 counts the vertical synchronous signal Vsync among the synchronous signals Vsync, Hsync, DE and DCLK input from the image analyzer 10 to count the number of frames, and outputs information about the counted frame number to the selector 206. Further, the pixel position determiner 204 detects the pixel positions of the converted image data Rc, Gc and Bc using at least one of the synchronous signals Vsync, Hsync, DE and DCLK.

For example, the pixel position determiner 204 counts the dot clock DCLK in an enable period of the data enable signal DE to detect a horizontal pixel position of each of the input image data Rc, Gc and Bc, counts the horizontal synchronous signal Hsync in a period in which the vertical synchronous signal Vsync and the data enable signal DE are simultaneously enabled, so as to detect a vertical pixel position of each of the input image data Rc, Gc and Bc, and outputs information about the detected pixel positions to the selector 206.

Figure 4:
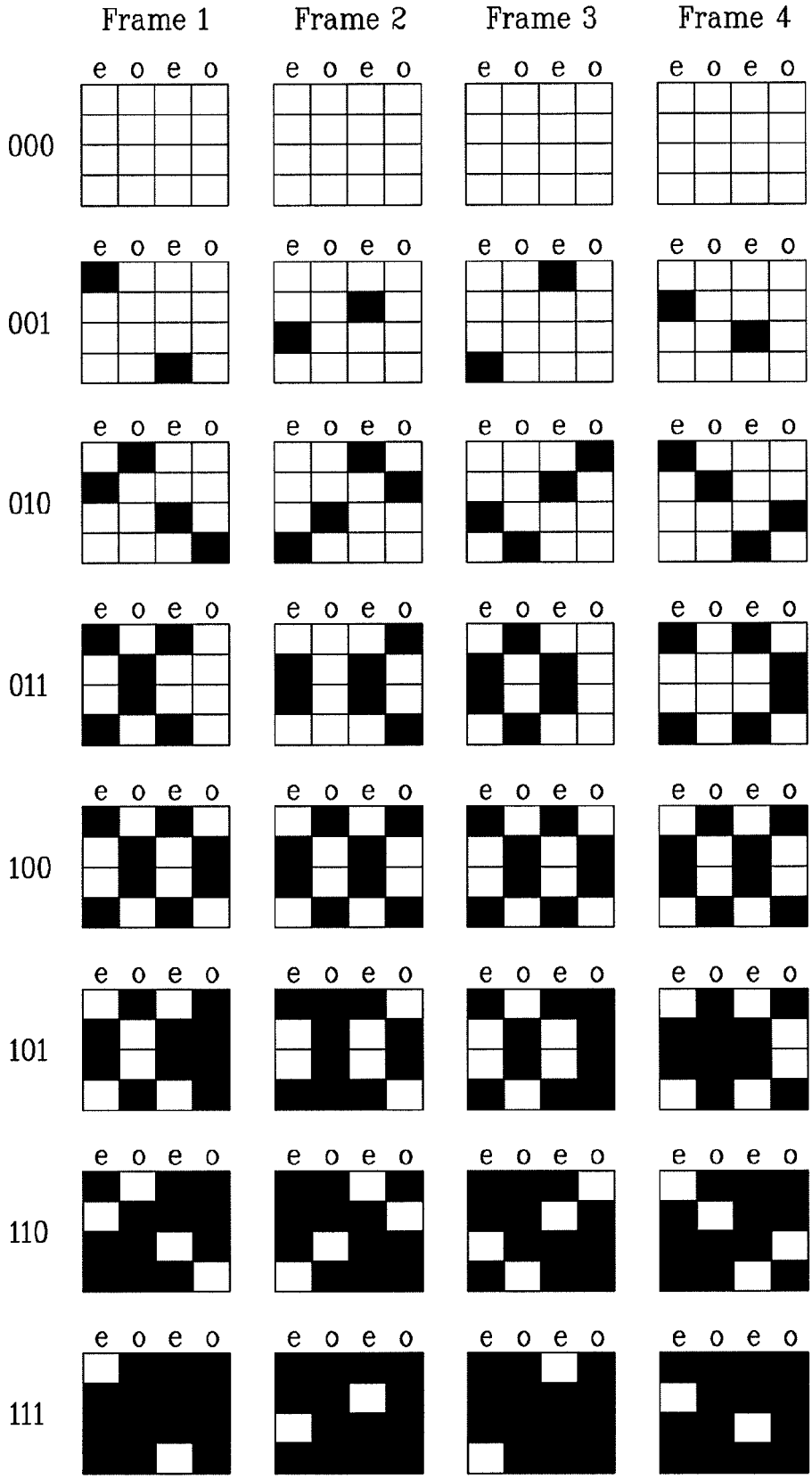
FIG. 4 is an overview showing a first set of FRC dithering patterns stored a memory shown in FIG. 2.
Figure 5:
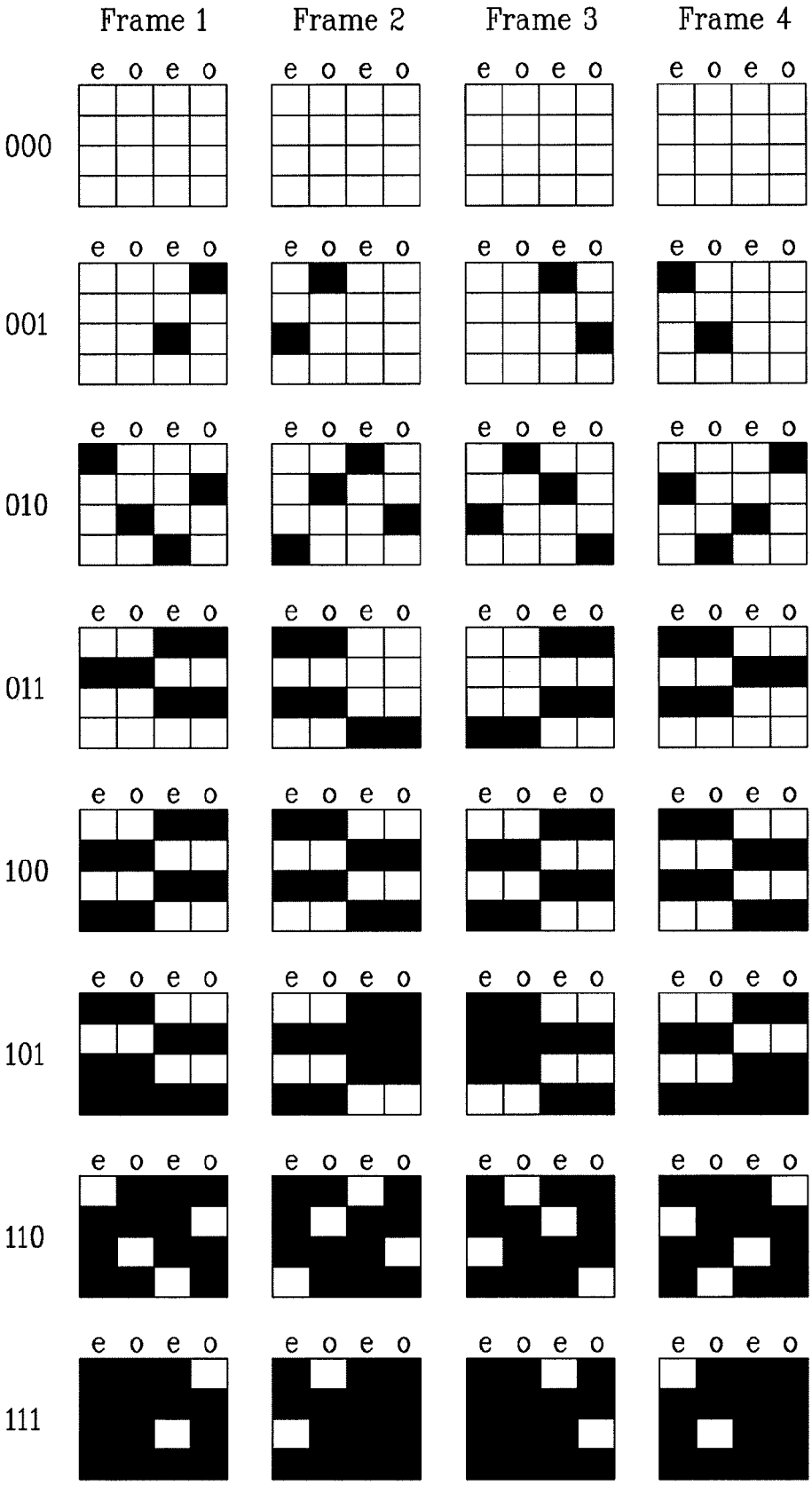
FIG. 5 is an overview showing a second set of FRC dithering patterns stored the memory shown in FIG. 2.
Figure 6:
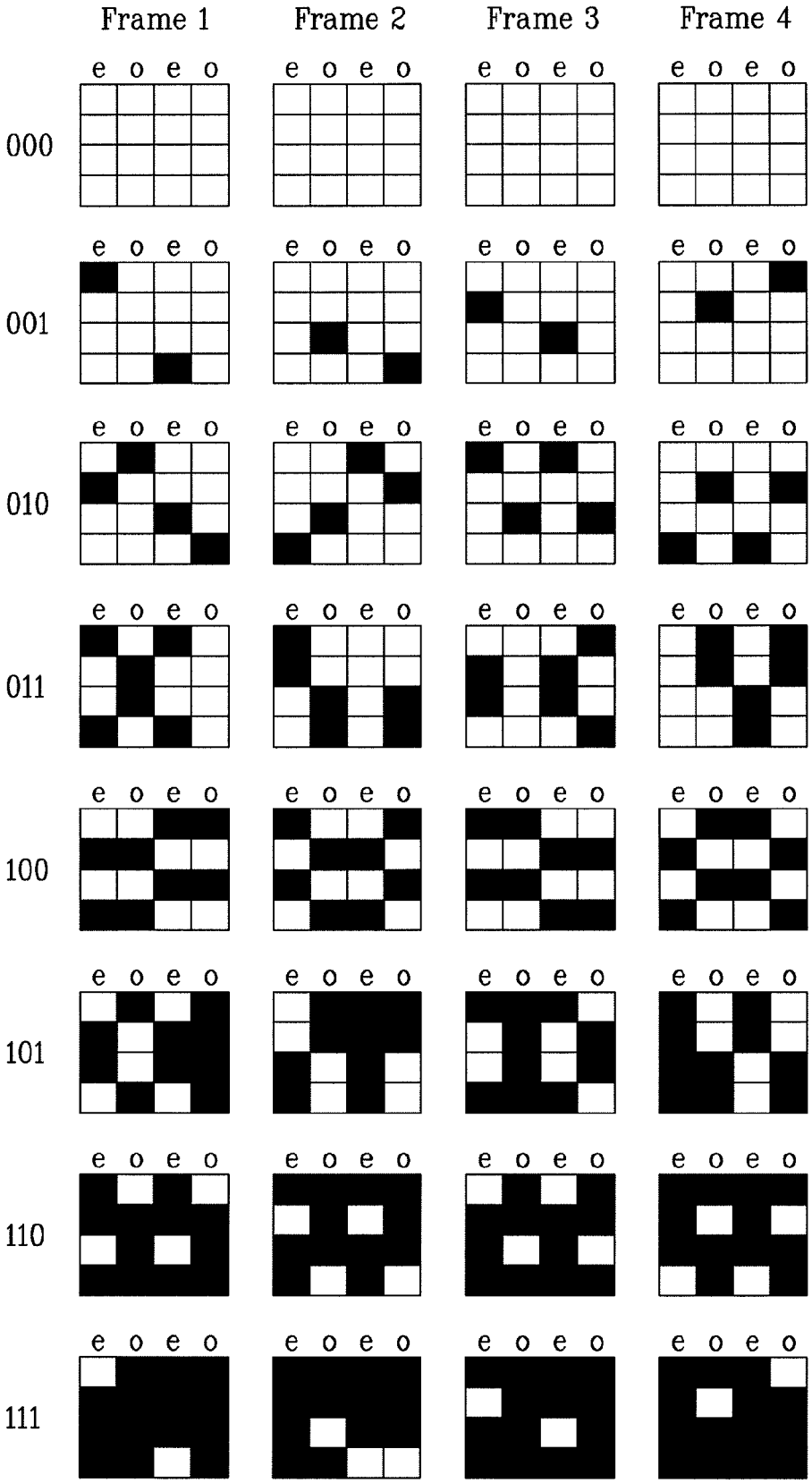
FIG. 6 is an overview showing a third set of FRC dithering patterns stored the memory shown in FIG. 2.

The memory 210 stores a plurality of sets of FRC dithering patterns optimized according to characteristics of a plurality of image patterns. For example, as shown in FIGS. 4 to 6, the memory 210 can respectively store first to third sets of FRC dithering patterns according to characteristics of the image patterns. In addition, each of the first to third sets of FRC dithering patterns includes a plurality of dithering patterns each having a 4×4 size and arranged in such a manner that the number of pixels having a dithering bit of "1" (black) increases gradually according to gray scale values of 0, 1/8, 2/8, 3/8, 4/8, 5/8, 6/8, 7/8 and 1 (a dither pattern having a gray scale value of 1 is not shown), in the form of a lookup table as shown in FIGS. 4 to 6.

In addition, each pixel of the dithering pattern has a dithering bit of "1" (black) or "0", and the gray scale value of each dithering pattern is determined in proportion to the number of pixels having the dithering bits of "1". Also, each of the first to third sets of FRC dithering patterns in FIGS. 4 to 6 further includes a plurality of dithering patterns in which the positions of pixels of "1" are different by frames with respect to the same gray scale value, namely, the positions of pixels of "1" are different in respective frames Frame 1 to Frame 4 with respect to the same gray scale value.

In other words, each of the first to third sets of FRC dithering patterns includes dithering patterns which are different by gray scales and by frames. The size of each dithering pattern and the positions of "1" in each dithering pattern may vary in various ways according to a designer's requirements or a predetermined image pattern.

Further, the first to third sets of FRC dithering patterns include the plurality of dithering patterns in which the positions of pixels of "1" are different with respect to the same gray scale value and the same frame, according to the corresponding image pattern. In the patterns shown in FIGS. 4 to 6, the column "e" represents an even pixel column and the column "o" represents an odd pixel column.

In addition, the selector 206 selects a corresponding set of FRC dithering patterns in the memory 210 based on the pattern analysis signal Ps and then selects a corresponding dithering bits Dr, Dg and Db in the selected set of FRC dithering patterns based on some low-order bits of each of the input image data Rc, Gc and Bc, the frame number information from the frame determiner 202, and the pixel position information from the pixel position determiner 204.

The selector 206 also selects the corresponding set of FRC dither patterns according to the pattern analysis signal Ps. For example, if the pattern analysis signal Ps is input as "011" indicating the vertical 2-dot pattern, the selector 206 selects a first set of FRC dithering pattern as shown in FIG. 4. If the pattern analysis signal Ps is input as "101" indicating the horizontal 2-dot pattern, the selector 206 selects a second set of FRC dithering pattern as shown in FIG. 5.

Also, if the pattern analysis signal Ps is input as "001" indicating the horizontal line pattern, the selector 206 selects a third set of FRC dithering pattern as shown in FIG. 6. The selector 206 also selects corresponding dithering bits Dr, Dg and Db in the selected set of FRC dithering patterns using a gray scale value corresponding to low-order 3 bits of each of the input image data Rc, Gc and Bc from the bit converter 120, the frame number information from the frame determiner 202 and the pixel position information from the pixel position determiner 204.

In addition, when each of the input image data Rc, Gc and Bc from the bit converter 120 is 9 bits long, the selector 206 selects dithering bits Dr, Dg and Db using low-order 3 bits among the 9 bits and outputs the remaining 6 bits to the adder 208. The selector 206 also selects one dithering pattern corresponding to a gray scale value corresponding to the low-order 3 bits of each of the image data Rc, Gc and Bc and the frame number information from the frame determiner 202, from among the selected set of FRC dithering patterns.

Further, the selector 206 selects dithering bits Dr, Dg and Db corresponding to the pixel position of each of the image data Rc, Gc and Bc in the selected dither pattern using the pixel position information from the pixel position determiner 204, and outputs the selected dithering bits Dr, Dg and Db to the adder 208. The adder 208 also adds the high-order 6 bits separated from each of the image data Rc, Gc and Bc and each of the dithering bits Dr, Dg and Db selected by the selector 206 and then supplies the added image data Ro, Go and Bo to the timing controller 8.

Accordingly, the FRC dithering unit 12 spatially and temporally disperses some low-order bits of each of the input image data Rc, Gc and Bc and selects the suitable set of FRC dither patterns according to the pattern analysis signal Ps from the image analyzer 10. The FRC dithering unit 12 also outputs the image data Ro, Go and Bo with a decreased number of bits compared with the input image data Rc, Gc and Bc, by the FRC dithering method.

Therefore, the FRC dithering unit 12 prevents interference between the predetermined image pattern and the predetermined FRC dither pattern, thereby minimizing a degradation of the picture quality. Further, the FRC dithering unit 12 may select the corresponding set of FRC dither patterns according to the inversion mode signal nPol with the pattern analysis signal Ps from the image analyzer 10. The FRC dithering method may also use different compensation dither patterns based on the pattern of the input image data RGB and the inversion mode.

As apparent from the above description, the driving apparatus and method of the liquid crystal display device according to an embodiment of the present invention performs the FRC dithering method using different sets of FRC dithering patterns based on the analyzing image pattern. Accordingly, the embodiment of the present invention prevents interference between the predetermined image pattern and the predetermined FRC dither pattern, thereby minimizing degradation of the picture quality. Further, it is possible to change the inversion mode and the FRC dithering mode based on the pattern of input image data to improve the quality of an image being displayed.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for driving a liquid crystal display device, the apparatus comprising:

an image analyzer configured to compare a pattern of input image data with a plurality of stored patterns of image data, to determine a stored pattern of image data from the plurality of stored patterns of image data that is most similar to the pattern of the input image data, and to output a pattern analysis signal indicating the determined stored pattern, wherein the image analyzer generates synchronous signals by sequentially comparing the input image data with the stored patterns, counts the synchronous signals, and determines the most similar stored pattern of the input image data when a largest count number of the synchronous signals is generated for the most similar stored pattern, wherein the plurality of stored patterns of image data include at least one of a horizontal line pattern, a vertical 2-dot pattern, a vertical line pattern, and a horizontal 2-dot pattern;

a dithering unit connected to the image analyzer and configured to select one set of a plurality of dithering pattern sets based on the output pattern analysis signal, to dither the input image data based on the selected dithering pattern set, and to output a dither-processed image data, wherein each of the plurality of dithering pattern sets includes a plurality of dithering patterns which are different by gray scales and by frames; and a data driver applying the dither-processed image data to a liquid crystal panel, wherein:

the dithering unit selects a dither bit in the a plurality of dithering patterns, which are included in the dithering pattern set selected according to the pattern analysis signal, using low-order bits of the input image data and adds the selected dither bit to the input image data, the plurality of stored patterns of image data are different from the plurality of dithering patterns and are not used in the dithering unit, the pattern analysis signal is not added to the input image data, and the plurality of stored patterns of image data are used only in the image analyzer and are not applied to the data driver.

2. The apparatus of claim 1, wherein the image analyzer is further configured to output an inversion mode signal to the data driver to set an inversion mode of the liquid crystal display device based on a value of the pattern analysis signal.

3. The apparatus of claim 1, wherein the image analyzer is further configured to compare the pattern of input image data with the plurality of stored patterns of image data on a horizontal line basis or on a frame basis using an external synchronous signal.

4. The apparatus of claim 1, further comprising:

a bit converter connected between the image analyzer and the dithering unit and configured to increase a number of bits of the input image data, wherein the dithering unit is further configured to separate the increased number of bits into high-order bits and low-order bits.

5. The apparatus of claim 4, wherein the dithering unit includes:

a frame number determiner configured to determine and output a frame number information of the input image data;

a pixel position determiner configured to determine and output a pixel position information of the input image data;

a selector configured to select and output corresponding dithering bits from the selected dithering pattern set based on at least a gray scale value corresponding to the low-order bits, the frame number information and the pixel position information; and an adder configured to add the selected dithering bits to the separated high-order bits resulting in the dither-processed image data.

6. A method of driving a liquid crystal display device, the method comprising:

comparing a pattern of input image data with a plurality of stored patterns of image data;

determining a stored pattern of image data from the plurality of stored patterns of image data that is most similar to the pattern of the input image data, wherein the plurality of stored patterns of image data include at least one of a horizontal line pattern, a vertical 2-dot pattern, a vertical line pattern, and a horizontal 2-dot pattern;

outputting a pattern analysis signal indicating the determined stored pattern;

selecting one set of a plurality of dithering pattern sets based on the output pattern analysis signal;

dithering the input image data based on the selected dithering pattern set; and outputting a dither-processed image data to a data driver, wherein synchronous signals are generated by sequentially comparing the input image data with the stored patterns, the synchronous signals are counted, and the most similar stored pattern of the input image data is determined when a largest count number of the synchronous signals is generated for the most similar stored pattern, wherein:

each of the plurality of dithering pattern sets includes a plurality of dithering patterns which are different by gray scales and by frames, the dithering step includes selecting a dither bit in the a plurality of dithering patterns, which are included in the dithering pattern set selected according to the pattern analysis signal, using low-order bits of the input image data and adding the selected dither bit to the input image data, the plurality of stored patterns of image data are different from the plurality of dithering patterns and is not used in dithering the input image data, the pattern analysis signal is not added to the input image data, and the plurality of stored patterns of image data are used only when comparing the input image data with a plurality of stored patterns and are not applied to the data driver.

7. The method of claim 6, further comprising:

outputting an inversion mode signal to the data driver to set an inversion mode of the liquid crystal display device based on a value of the pattern analysis signal.

8. The method of claim 6, wherein the comparing step sequentially compares the pattern of input image data with the plurality of stored patterns of image data on a horizontal line basis or on a frame basis using an external synchronous signal.

9. The method of claim 6, further comprising:

increasing a number of bits of the input image data; and separating the increased number of bits into high-order bits and low-order bits.

10. The method of claim 9, wherein the dithering step further comprises:

determining and outputting a frame number information of the input image data; and determining and outputting a pixel position information of the input image data, wherein the step of selecting the dither bit includes selecting and outputting corresponding dithering bits from the selected dithering pattern set based on at least a gray scale value corresponding to the low-order bits, the frame number information and the pixel position information; and wherein the adding step includes adding the selected dithering bits to the separated high-order bits resulting in the dither-processed image data.

11. The apparatus of claim 1, wherein:

the image analyzer is further configured to set an inversion mode of the liquid crystal display device based on the pattern analysis signal and to output an inversion mode signal with the pattern analysis signal to the dithering unit, and the dithering unit selects one set of the plurality of dithering pattern sets based on the pattern analysis signal with the inversion mode signal from the image analyzer.

12. The apparatus of claim 1, wherein:

if the pattern analysis signal indicates the vertical 2-dot pattern, the dithering unit selects a first dithering pattern set which includes at least three dithering pattern corresponding to different gray scale value and including at least a first block having the vertical 2-dot pattern, if the pattern analysis signal indicates the horizontal 2-dot pattern, the dithering unit selects a second dithering pattern set which includes at least three dithering pattern corresponding to different gray scale value and including at least a second block having the horizontal 2-dot pattern; and if the pattern analysis signal indicates the horizontal line pattern, the dithering unit selects a third dithering pattern set which includes at least three dithering pattern corresponding to different gray scale value and alternating a first dithering pattern and a second dithering pattern, wherein:

the first block comprises first two pixels, having a first dither bit and being arranged in a vertical direction, and second two pixels, having a second dither bit and being arranged in the vertical direction, adjacent to the first two pixels in a horizontal direction, the second block comprises third two pixels, having the first dither bit and being arranged in the horizontal direction, and fourth two pixels, having the second dither bit and being arranged in the horizontal direction, adjacent to the third two pixels in a vertical direction, the first dithering pattern includes the first block, and the second dithering pattern includes the second block.

13. The method of claim 6, further comprising:

generating an inversion mode signal of the liquid crystal display device based on the pattern analysis signal and outputting the inversion mode signal, wherein the dithering step selects the one set of the plurality of dithering pattern sets based on the inversion mode signal with the pattern analysis signal.

14. The method of claim 6, wherein:

if the pattern analysis signal indicates the vertical 2-dot pattern, the dithering unit selects a first dithering pattern set which includes at least three dithering pattern corresponding to different gray scale value and including at least a first block having the vertical 2-dot pattern, if the pattern analysis signal indicates the vertical 2-dot pattern, the dithering unit selects a first dithering pattern set which includes at least three dithering pattern corresponding to different gray scale value and including at least a first block having the vertical 2-dot pattern, if the pattern analysis signal indicates the horizontal 2-dot pattern, the dithering unit selects a second dithering pattern set which includes at least three dithering pattern corresponding to different gray scale value and including at least a second block having the horizontal 2-dot pattern; and if the pattern analysis signal indicates the horizontal line pattern, the dithering unit selects a third dithering pattern set which includes at least three dithering pattern corresponding to different gray scale value and alternating a first dithering pattern and a second dithering pattern, wherein:

the first block comprises first two pixels, having a first dither bit and being arranged in a vertical direction, and second two pixels, having a second dither bit and being arranged in the vertical direction, adjacent to the first two pixels in a horizontal direction, the second block comprises third two pixels, having the first dither bit and being arranged in the horizontal direction, and fourth two pixels, having the second dither bit and being arranged in the horizontal direction, adjacent to the third two pixels in a vertical direction, the first dithering pattern includes the first block, and the second dithering pattern includes the second block.

* * * * *